United States Patent [19]

Nielsen

[11] Patent Number: 4,631,899

[45] Date of Patent: Dec. 30, 1986

[54] METHOD OF DISPENSING A METERED QUANTITY OF SNUFF AND OF PACKAGING THE INDIVIDUAL, METERED QUANTITIES OF SNUFF

[75] Inventor: Borge D. Nielsen, Odense, Denmark

[73] Assignee: Hermann Kruger's EFTF. A/S, Denmark

[21] Appl. No.: 651,814

[22] Filed: Sep. 18, 1984

[30] Foreign Application Priority Data

Sep. 20, 1983 [DK] Denmark ..... 4280/83

[51] Int. Cl.[4] ..... B65B 1/26

[52] U.S. Cl. ..... 53/433; 53/405; 53/436; 53/452; 53/539; 53/553

[58] Field of Search ..... 53/263, 281, 282, 284, 53/158, 427, 433, 450, 452, 467, 471, 472, 488, 489, 473, 478, 539, 553, 558, 560, 591, 405, 511, 510; 206/45.33, 45.34, 523

[56] References Cited

U.S. PATENT DOCUMENTS

| | | | |
|---|---|---|---|
| 2,124,959 | 7/1938 | Vogel | 53/471 |
| 3,216,832 | 11/1965 | King | 53/405 |
| 3,340,668 | 9/1967 | Bofinger | 53/405 |
| 3,521,422 | 7/1970 | Tabor | 53/471 |
| 3,972,153 | 8/1976 | Kiellarson et al. | 53/433 |

FOREIGN PATENT DOCUMENTS

| | | | |
|---|---|---|---|
| 286704 | 10/1952 | Switzerland | 53/558 |
| 1539729 | 1/1979 | United Kingdom | 53/405 |

*Primary Examiner*—James F. Coan

*Attorney, Agent, or Firm*—Scully, Scott, Murphy & Presser

[57] ABSTRACT

In a method of dispensing metered quantities of snuff and of packaging the individual quantities of snuff, the individual snuff quantities are shaped while being packaged, there being used an upwardly and downwardly open frame (1) divided by internal walls into a plurality of spaces (5) of the same size. These spaces (5) are closed downwardly by means of a base sheet (2) welded to the frame, a metered quantity of snuff is evenly distributed in the spaces (5) and the frame (1) is hermetically closed on the top side by means of a top sheet (10), optionally after being placed in a vacuum chamber (9) or after mechanical compression of the snuff in the individual spaces (5).

1 Claim, 4 Drawing Figures

METHOD OF DISPENSING A METERED QUANTITY OF SNUFF AND OF PACKAGING THE INDIVIDUAL, METERED QUANTITIES OF SNUFF

The invention relates to a method of dispensing metered quantities of snuff and of packaging the individual, metered quantities of snuff.

A method of the present type is known, comprising packaging the individual metered quantities of snuff in a liquid permeable bag of a type similar to a tea bag. A plurality of such bags, e.g. 24, is then placed in a box which can be closed almost airtight and thus retain the moisture in the snuff quantities during storage.

When the consumer is to use this article, he will, when removing the first snuff bag from the box, cause some of the moisture to escape from the other snuff bags, so that the quality deteriorates as the box is emptied. In use, the consumer takes the whole bag into his mouth, which many consumers consider a drawback compared to just putting the snuff powder into their mouthes. Finally, it is a rather time-consuming and thus expensive process to fill snuff into the individual bags.

The object of the invention is to provide a simple method of the type stated above, wherein snuff is dispensed in metered quantities which are packaged individually and airtight so that the consumer can take out a quantity without breaking the airtight package around each of the other quantities.

This object is achieved according to the invention by carrying out the stated method as defined in the characterizing portion of claim 1.

In this simple method each individual quantity of snuff is metered and shaped like a pill while being packaged. The frame is a suitable storage location for the snuff quantities which the consumer can take out one by one and break the package and then put the snuff quantity in question into his mouth when the package is removed completely.

As stated in claims 2 and 3 the closure of the frame at the top, after compression of snuff in the individual spaces, can be effected in a vacuum chamber or in an apparatus in which the snuff in the individual spaces has been mechanically compressed.

Figure 1:
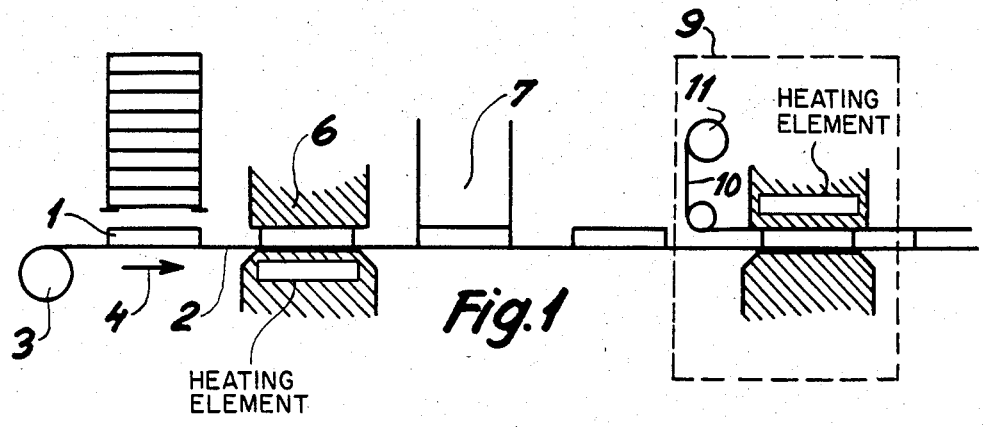
Figure 2:
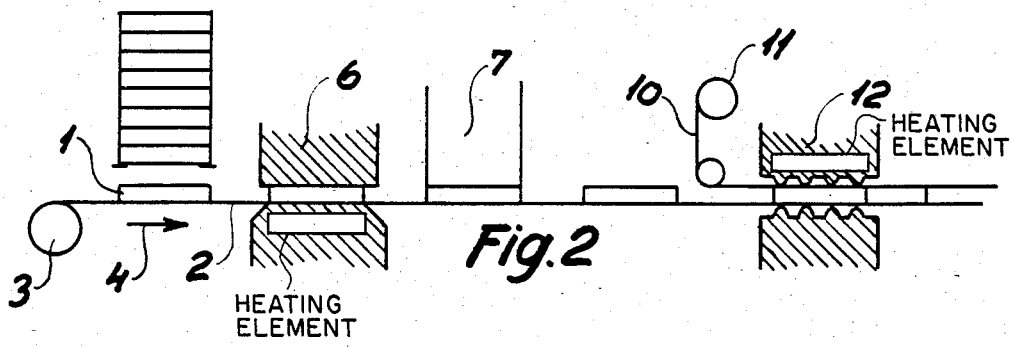
Figure 3:
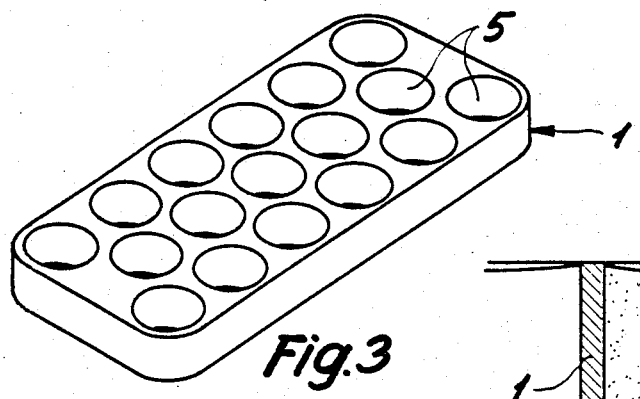
Figure 4:
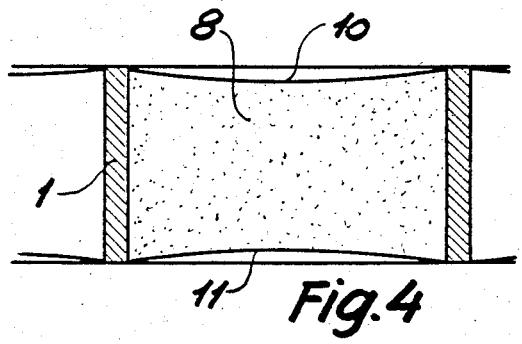

The invention will be described more fully below with reference to the drawing, in which FIG. 1 shows a method of the invention in which a vacuum chamber is used during closure of the top sheet with the frame, FIG. 2 shows another method of the invention which differs from the method in FIG. 1 only in that a mechanical compression apparatus is used instead of the vacuum chamber, FIG. 3 is a perspective view of an embodiment of the frame shown in FIGS. 1 and 2, and FIG. 4 is a longitudinal section of a space in the frame and parts of its adjacent space after packaging.

In the method shown in FIG. 1 the frames 1, which are shown and described in detail in connection with FIG. 1, successively drop down on a strip 2 of sheet which is pulled off from a roll 3 in the direction of the arrow 4; so that the frames 1 with a shown spacing are moved along together with the strip 2. Of course, the strip 2 may be supported by a conveyor belt (not shown).

As shown in FIG. 3, internal walls divide each frame 1 into a plurality of spaces 5 of the same size which are circular-cylindrical in the shown embodiment. The spaces 5 are open upwardly and downwardly, and the frame 1 is preferably made of plastics.

When the individual frames 1 in FIG. 1 reach the station shown at 6, the strip 2 of plastics sheet is welded to the underside of the frame so that the spaces 5 are closed downwardly by the strip 2 serving as a base sheet.

In the next station 7 a metered quantity of snuff (shown at 8 in FIG. 4) is filled into the frame 1 and is evenly distributed in the spaces 5 now closed downwardly.

The filled frames are then moved into a vacuum chamber 9 shown in broken lines, where the pressure is reduced, e.g. to one-third of the atmospheric pressure. In the chamber 9, a strip 10 of a sheet is passed from a roll 11 across the top side of the frame in question and is welded or heat sealed to the top side of the frame. Thus, the frames 5 will also be closed upwardly by the strip 10 serving as a top sheet.

When the individual frames 1 with hermetically sealed spaces 5, which contain snuff 8, are then removed from the vacuum chamber 9, the atmospheric pressure against the base sheet 2 and the top sheet 10 causes the snuff 8 contained in the spaces to be compressed so as to form a coherent pill of the shape shown in FIG. 4.

To the extent the method shown in FIG. 2 is identical with the method shown in FIG. 1 an explanation is superfluous, and the same reference numerals as in FIG. 1 are used.

The vacuum chamber from FIG. 1 is replaced by an apparatus 12 for mechanical compression of the snuff 8 in the individual spaces 5 in the frame 1 before closing with the top sheet 10. During this pressing operation knobs on the top and lower jaws of the pressing apparatus 12 press the top and base sheets 10 and 2, respectively, against the snuff 8 in the spaces 5. This will expel part of the air present in the spaces 5 in the frame 1. Finally, the top sheet 10 is heat sealed against the frame 1 so that the snuff 8 in the individual spaces 5 will be hermetically confined.

The compressed material will exert a pressure on the sheet, but as a partial vacuum exists in the spaces 5, the atmospheric pressure will hold the sheet in an arc against the material, as shown in FIG. 4.

I claim :

1. A method of dispensing metered quantities of snuff and of packaging the individual, metered quantities of snuff, comprising placing an upwardly and downwardly open frame, divided by internal walls into a plurality of spaces of the same size, on a base sheet, attaching the base sheet to the underside of the frame, evenly distributing a metered quantity of snuff in the individual spaces in the frame, hermetically closing the frame thus filled at the top by means of a top sheet and subjecting the thus filled frame to pressure below atmospheric so that the snuff is simultaneously shaped and packaged into a pill-shaped product which retains its shape upon unpackaging.

* * * * *